US005714245A

United States Patent [19]

Atherton et al.

[11] Patent Number: 5,714,245

[45] Date of Patent: Feb. 3, 1998

[54] ANTI-BLOCKING CLEAR INK RECEIVING SHEET

[75] Inventors: David Atherton, Saunders Town; Sen Yang, Warwick, both of R.I.; Miaoling Huang, Danielsen, Conn.; Steven J. Sargeant, West Warwick, R.I.; Kang Sun, North Attleboro, Mass.

[73] Assignee: Arkwright, Incorporated, Fiskeville, R.I.

[21] Appl. No.: 274,720

[22] Filed: Jul. 18, 1994

[51] Int. Cl.[6] ..... B41M 5/00

[52] U.S. Cl. ..... 428/323; 428/195; 428/206; 428/325; 428/327; 428/331; 428/341; 428/409; 347/105

[58] Field of Search ..... 428/195, 212, 428/323, 327, 402, 206, 341, 409, 325, 331

[56] References Cited

U.S. PATENT DOCUMENTS

| | | | |
|---|---|---|---|
| 4,592,951 | 6/1986 | Viola | 428/323 |
| 4,775,594 | 10/1988 | Desjarlais | 428/500 |
| 4,902,568 | 2/1990 | Morohoshi | 428/331 |
| 4,935,307 | 6/1990 | Iqbal et al. | 428/500 |
| 5,084,338 | 1/1992 | Light | 428/500 |
| 5,139,867 | 8/1992 | Light | 428/500 |
| 5,194,317 | 3/1993 | Sato et al. | 428/195 |
| 5,206,071 | 4/1993 | Atherton et al. | 425/195 |

FOREIGN PATENT DOCUMENTS

| | | |
|---|---|---|
| 0380133 | 8/1990 | European Pat. Off. . |
| 2263903 | 8/1993 | United Kingdom . |

*Primary Examiner*—Pamela R. Schwartz

*Attorney, Agent, or Firm*—Birch, Stewart, Kolasch & Birch, LLP

[57] ABSTRACT

The present invention is directed to an ink-receiving sheet having anti-blocking properties, containing (A) a polymer substrate; (B) an ink-receptive coating disposed on at least one layer which having a water-soluble component; and (C) particulates dispersed in the ink-receptive coating, having an average particle size of from 15 um to about 50 um, a particle size span is equal to or smaller than 1.0, and a refractive index of from about 1.2 to about 2.4. The present invention is also directed to the ink receptive coating per se, and to methods of ink jet printing using the above ink-receiving sheet.

17 Claims, No Drawings

ANTI-BLOCKING CLEAR INK RECEIVING SHEET

BACKGROUND OF THE INVENTION

1. Field of the Invention

The present invention relates to an ink receiving sheet and, more particularly, to a transparent ink receiving sheet having anti-blocking properties for use with ink jet printers.

2. Description of the Related Arts

In order to achieve high color density and fidelity during ink jet printing on an ink receiving sheet, the laydown of the ink receiving sheet is usually high. However, current commercial ink receiving sheets, in particular transparent ink receiving sheets, do not allow high ink laydown because of blocking between image that is formed on the ink receiving sheet and any materials that may come into contact with the image. In other words, because of the nature of the ink and the ink receiving sheet, ink undesirably transfers from the ink receiving sheet to materials in contact with the ink receiving sheet. The blocking has become one of the major problems in the field, particularly with high speed ink jet printers.

There have been many attempts to improve anti-blocking performance of ink receiving sheets. A number of designs have been proposed for use in various ink receiving sheets. Iqbal et al., U.S. Pat. No. 4,935,307, discloses an ink permeable protective layer containing a particulate material; Desjarlais, U.S. Pat. No. 4,775,594, discloses the use of silica as an anti-blocking agent; Light, U.S. Pat. No. 5,084,338, discusses inert particles having a particle size of 25 um or less; Bedell, U.S. Pat. No. 4,547,405, also discusses use of particles such as glass beads in the ink receiving sheet. Although these proposals disclose the use of particles, none of them have specified three key functional parameters: particle size distribution, particle size limitation and refractive index. Desired anti-blocking property and clarity only can be achieved when the particle size, particle size distribution and refractive index are optimized. When the particle size is too small, the particles do not protrude through the ink receiving coating and anti-blocking property is poor. When the particles are too large, the particles will be projected when the ink receiving sheet is used as a transparency for presentation. In addition, the difference in refractive indices between the particle and the ink receiving coating affects the clarity and projection quality. Obviously, the solutions proposed in the prior art do not solve the problems in the field. These designs have to compromise anti-blocking properties and clarity. As a result, an undesirable compromise must be made between ink laydown and anti-blocking property.

The present invention discloses an optimized design that offers both excellent anti-blocking property and high clarity of the ink receiving sheet.

SUMMARY OF THE INVENTION

An object of the present invention is to provide a transparent ink-receiving sheet which will avoid the blocking problems associated with prior art ink receiving sheets, while still maintaining high ink laydown and clarity.

Another object of the present invention is to provide an ink-receptive coating for an ink receiving sheet which will impart anti-blocking properties without the need for a separate ink-permeable protective coating, while still maintaining high ink laydown and good clarity.

A further object of the present invention is to provide an improved ink jet printing process for printing images on transparent ink jet receiving sheets, which avoids the problems associated with prior art processes.

These and other objects and advantages are obtained by the present invention, which presents a solution to the need for an anti-blocking clear ink receiving sheet. The improvements in anti-blocking property and clarity are attained, according to the invention, by using specific particulates as a spacer in the ink receiving sheet.

More particularly, the objects and advantages of the present invention are obtained by an ink-receiving sheet having anti-blocking properties, comprising (A) a polymer substrate; (B) an ink receptive coating disposed on at least one side of the substrate, and comprising at lease one layer which comprises a water-soluble component; (C) particulates dispersed in said ink receptive coating, having an average particle size of from about 15 um to about 50 um, preferably from about 20 um to 40 um and a particle size span equal to or smaller than 1.0, preferably <0.8, and (D) particulates dispersed in said ink receptive coating having a refractive index of from about 1.2 to about 2.4, wherein the ink receptive coating has a surface through which said particulates are exposed.

The objects and advantages of the present invention are also obtained by an ink receptive coating for an ink receiving sheet, comprising (1) at least one layer comprising a water-soluble component; and (2) particulates dispersed therein having an average particle size of from 15 um to about 50 um, a particle size span equal to or smaller than 1.0 and a refractive index of from 1.2 to about 2.4, wherein said coating has a surface through which the particles are exposed.

Further scope of applicability of the present invention will become apparent from the detailed description given hereinafter. However, it should be understood that the detailed description and specific examples, while they may indicate preferred embodiments of the invention, are given by way of illustration only, since various changes and modifications within the spirit and scope of the invention will become apparent to those skilled in the art from this detailed description.

DETAILED DESCRIPTION OF THE INVENTION

Examples of suitable substrates for the ink receiving sheet include transparent plastics, such as poly(ethylene terephthalate), polycarbonate, polystyrene, cellulose esters, poly(vinyl acetate), and others. The thickness of the substrate is not particularly restricted, but should be in the range of about 1.5 to about 10 mils, preferably about 2.0 to about 5.0 mils. The substrates may be pretreated to enhance adhesion of the coatings thereto. The ink receptive coating, Which is disposed on at least one side of the polymer substrate, contains at least one layer comprising at least one water-soluble component. The ink receptive coating may have a single layer structure, or may have multiple layers. When multiple layers are present, the particulates can reside in any of these layers, as long as the particulates are exposed on the surface of the ink receptive coating.

The ink receptive coating may contain both water-soluble and water-insoluble components, as long as the ink receptive coating functions to receive ink. Examples of water-soluble components include poly(vinyl alcohol), poly(vinyl acetate), poly(vinyl pyrrolidone), poly(acrylic acid), cellulose esters, gelatins, proteins, poly(ethylene oxide), alginates, poly (ethylene glycol) and water-soluble gums. Examples of water-insoluble components include methyl methacrylate, styrene, urethane, butadiene, 2-hydroxyethyl acrylate, ethyl acrylate, N-hydroxyethyl acylamide, N-hydroxymethyl acrylamide, and ethylene terephthalate. These water-soluble and water-insoluble components may be incorporated as the component of a homopolymer, a copolymer, or a polymer blend. The coating weight of the ink receptive coating may be from about 2 g/m$^2$ to about 30 g/m$^2$ and preferably, from about 4 g/m$^2$ to about 20 g/m$^2$.

The particulates disclosed in this invention have an average particle size of from about 15 um to about 50 um, preferably from about 20 um to about 40 um; a particle size span is equal to or smaller than 1.0, preferably <0.8; and a refractive index of from about 1.2 to about 2.4. Examples of the particulates include glass beads, poly(methyl methacrylate), polystyrene, starch, silica, polyurethane, calcium carbonate and other organic and inorganic particles having specified particle size, particle size span and refractive index.

The concentration of the particulates in the ink receiving sheet may be from about 0.5% to about 10% (weight percentage based on coating solid content), depending on the particle size, the particle size distribution and ink laydown. Usually, a low concentration is required when large particulates having small particle size span are used.

The smoothness of the ink receiving sheet disclosed in this invention may be from about 200 to about 400 Sheffield units, preferably from about 240 to about 360 Sheffield units. The haze of the ink receiving sheet is less than about 8%. The Sheffield smoothness was measured on Paper Smoothness Tester, model 538 (Hagerty Technologies). The haze was measured on Haze Guard System, XL-211 (BKY Gardner). The average particle size and the particle size distribution were measured on MasterSizer, MS-20 (Malvern Instruments). The average particle size is defined by the mean particle size or D50. The particle size distribution is expressed by the particle size span, which is defined as:

$$\text{Particle Size Span}=(D90-D10)/(D50)$$

where D90 is the 90th percentile diameter, D10 is the 10th percentile diameter, and D50 is the 50th percentile diameter.

When the ink receptive coating is on one side of the substrate, the side of the substrate which is not covered with ink receptive coating may be attached to a backing material in order to reduce electrostatic charge and to reduce sheet-to-sheet friction and sticking. The backing material may be either a polymer coating, an ink receptive coating, a polymer film, or paper, in accordance with what is known in the art, and is not particularly limited. To prevent stacking blocking, the particles disclosed in this invention can also be added in the backing materials.

Any of a number of art recognized coating methods may be employed to coat the ink receptive coating onto the polymer substrate, such as roller coating, wire-bar coating, dip coating, extrusion coating, air knife coating, curtain coating, slide coating, doctor coating, or gravure coating. Such techniques are well known in the art.

The following Examples are merely illustrative of the invention and are not to be construed as limiting the invention.

EXAMPLE 1

| | | |
|---|---|---|
| Underlayer | PVP-K90[1] | 12.0 parts |
| | Copolymer A[2] | 7.5 parts |
| | Particulate I[3] | 0.3 parts |
| | Dowanol PM[4] | 17.3 parts |
| | MEK | 61.4 parts |
| Surface layer | Hydroxyethyl Cellulose[5] | 1.8 parts |
| | Water | 97.7 parts |

[1]Poly(vinyl pyrrolidone), GAF Corporation.
[2]A copolymer of methyl methacrylate and hydroxyethyl methacrylate, 40% solid.
[3]Glass bead, the average particle size is about 22 um, the particle size span is about 0.72 and the refractive index is about 1.65 (from the supplier).
[4]Propylene glycol monomethyl ether, Dow Chemical Corporation.
[5]Hydroxyethyl cellulose, Union Carbide.

The underlayer coating was coated on the polyester base using a No. 36 Meyer rod. After drying the underlayer coating at 120° C. for about 2 minutes, the surface layer coating was coated using No. 8 Meyer rod under the same conditions. The dry coat weight of the ink receptive coating is about 10 g/m$^2$.

EXAMPLE 2

| | | |
|---|---|---|
| Underlayer | PVP-K90 | 9.6 parts |
| | Copolymer A | 6.0 parts |
| | Quaternary copolymer[1] | 8.6 parts |
| | Particulate I | 0.3 parts |
| | Dowanol PM | 16.3 parts |
| | MEK | 57.7 parts |
| Surface layer | Hydroxyethyl Cellulose | 1.8 parts |
| | Water | 97.7 parts |

[1]Quaternary copolymer of methyl methacrylate and dimethylaminoethyl methacrylate, 35% solid.

The underlayer coating was coated on the polyester base using a No. 36 Meyer rod. After drying the underlayer coating at 120° C. for about 2 minutes, the surface layer coating was coated using No. 8 Meyer rod under the same conditions. The dry coat weight of the ink receptive coating is about 10 g/m$^2$.

EXAMPLE 3

| | | |
|---|---|---|
| Underlayer | PVP-K90 | 12.0 parts |
| | Copolymer A | 7.5 parts |
| | Particulate II[1] | 0.3 parts |
| | Dowanol PM | 17.3 parts |
| | MEK | 61.4 parts |
| Surface layer | Hydroxyethyl Cellulose | 1.8 parts |
| | Water | 97.7 parts |

[1]Poly(methyl methacrylate), the average particle size is about 28 um, the particle size span is about 0.65 and the refractive index is about 1.49 (from J. Brandrup & E. H. Immergut, Polymer Handbook, third edition, John Wiley & Sons, 1989).

The underlayer coating was coated on the polyester base using No. 38 Meyer rod. After drying the underlayer coating at 120° C. for about 2 minutes, the surface layer coating was coated using a No. 8 Meyer rod under the same conditions. The dry coat weight of the ink receptive coating is about 10 g/m$^2$.

EXAMPLE 4

| | | |
|---|---|---|
| Underlayer | PVP-K90 | 8.4 parts |
| | Copolymer B[1] | 8.4 parts |
| | Quaternary copolymer | 9.8 parts |
| | Particulate III[2] | 0.2 parts |
| | Dowanol PM | 13.5 parts |
| | MEK | 58.1 parts |
| Surface layer | Hydroxyethyl Cellulose | 1.8 parts |
| | Water | 97.7 parts |

[1]A graft copolymer of methylmethacrylate and hydroxyethyl methacrylate, 25% solid.
[2]Glass bead, the average particle size is about 41 um, the particle size span is about 0.3, and the refractive index is about 1.51 (from the supplier).

The underlayer coating was coated on the polyester base using a No. 46 Meyer rod. After drying the underlayer coating at 120° C. for about 2 minutes, the surface layer coating was coated using No. 8 Meyer rod under the same conditions. The dry coat weight of the ink receptive coating is about 10 g/m$^2$.

COMPARATIVE EXAMPLE 1

| | | |
|---|---|---|
| Underlayer | PVP-K90 | 8.67 parts |
| | Copolymer A | 5.42 parts |
| | Particulate IV[1] | 0.2 parts |
| | Quaternary copolymer | 10.1 parts |
| | Dowanol PM | 20.7 parts |
| | MEK | 53.5 parts |
| Surface layer | Hydroxyethyl Cellulose | 0.5 parts |
| | Particulate IV | 0.14 parts |
| | Water | 98.4 parts |

[1]Poly(methyl methacrylate), the average particle size is about 18 um, the particle size span is about 1.19 and the refractive index is about 1.49.

The underlayer coating was coated on the polyester base using a No. 46 Meyer rod. After drying the underlayer coating at 120° C. for about 2 minutes, the surface layer coating was coated using a No. 16 Meyer rod under the same conditions. The dry coat weight of the ink receptive coating is about 10 g/m$^2$.

COMPARATIVE EXAMPLE 2

| | | |
|---|---|---|
| Underlayer | PVP-K90 | 8.7 parts |
| | Copolymer B | 8.7 parts |
| | Quaternary copolymer | 10.1 parts |
| | Particulate V[1] | 0.4 parts |
| | Dowanol PM | 20.7 parts |
| | MEK | 50.0 parts |
| Surface layer | Hydroxyethyl Cellulose | 1.8 parts |
| | Water | 97.7 parts |

[1]Corn starch, the average particle size is about 15 um, the particle size span is about 1.05 and the refractive index is about 1.52 (from Kirk-Othmer Encyclopedia of Chemical Technology, second edition, Volume 18, John Wiley & Sons, 1969).

The underlayer coating was coated on the polyester base using a No. 46 Meyer rod. After drying the underlayer coating at 120° C. for about 2 minutes, the surface layer coating was coated using a No. 8 Meyer rod under the same conditions. The dry coat weight of the ink receptive coating is about 10 g/m$^2$.

Samples prepared according to the above Examples and Comparative Examples were printed on a Hewlett-Packard ink jet printer with a color ink cartridge at 50% RH and 22° C. The samples were allowed to dry for about 15 minutes and then were placed in a plastic sleeve. The samples were stored in the plastic sleeve at 80% RH and 30° C. for 72 hours. Blocking was judged by examining the size of the contact areas between the image and the sleeve and assigning a scaled score thereto (a score of 5 being the best and a score of 0 being the worst). The results are summarized in Table 1.

TABLE I

Performance Comparisons

| | Haze (%) | Smoothness (Sheffield Units) | Blocking |
|---|---|---|---|
| Example 1 | 2.5 | 336 | 5 |
| Example 2 | 2.7 | 341 | 5 |
| Example 3 | 3.7 | 330 | 5 |
| Example 4 | 1.7 | 373 | 5 |
| Comparative Example 1 | 10.5 | 273 | 3 |
| Comparative Example 2 | 8.9 | 193 | 0 |

The invention being thus described, it will be obvious that the same may be varied in many ways. Such variations are not to be regarded as a departure from the spirit and scope of the invention and all such modifications, as would be obvious to one skilled in the art, are intended to be included within the scope of the following claims.

What is claimed is:

1. A transparent ink-receiving sheet having anti-blocking properties, comprising:

(a) a polymer substrate;

(b) an ink-receptive coating disposed on at least one side of said substrate, comprising at least one layer which comprises a water-soluble component; and (c) particulates dispersed in said ink-receptive coating, having an average particle size of from about 15 um to about 50 um, a particle size span equal to or smaller than 1.0 and a refractive index of from about 1.2 to about 2.4;

provided that the ink receptive coating is present in an amount of from about 2 g/m$^2$ to about 30 g/m$^2$.

2. The ink receiving sheet according to claim 1, wherein said ink receptive coating is present in an amount of from about 4 g/m$^2$ to about 20 g/m$^2$.

3. The ink receiving sheet according to claim 1, having a Sheffield smoothness of from about 200 to about 400.

4. The ink receiving sheet according to claim 3, wherein said Sheffield is from about 240 to about 360.

5. The ink receiving sheet according to claim 1, having a haze of less than 8%.

6. The ink receiving sheet according to claim 1, wherein said ink receptive coating comprises multiple layers.

7. The ink receiving sheet according to claim 1, wherein said water-soluble component is selected from the group consisting of poly(vinyl alcohol), poly(vinyl pyrrolidone), gelatin, poly(vinyl acetate), cellulose ester, poly(acrylic acid), alginate, protein, poly(ethylene oxide), poly(ethylene glycol), water soluble gum, and mixtures thereof.

8. The ink receiving sheet according to claim 1, wherein said particulates are selected from the group consisting of glass beads, silica, polyolefins, polystyrene, poly(methyl methacrylate), starch and calcium carbonate.

9. The ink receiving sheet according to claim 1, wherein the concentration of particulates is about 0.5% to about 10%.

10. The ink receiving sheet according to claim 1, wherein said substrate has a thickness of about 1.5 to about 5 mils.

11. The ink receiving sheet according to claim 10, wherein said thickness is about 2.0 to about 5.0 mils.

12. The ink receiving sheet according to claim 1, wherein said polymer substrate is a transparent plastic selected from the group consisting of polyester, polycarbonate, polystyrene, cellulose ester, poly(vinyl acetate), and mixtures thereof.

13. A process for ink jet printing, comprising applying liquid ink to the ink receptive coating of the ink receiving sheet according to claim 1.

14. A transparent ink-receiving sheet as recited in claim 1, wherein said particulates comprise poly (methylmethacrylate).

15. A transparent ink-receiving sheet as recited in claim 1, wherein said particulates comprise glass beads.

16. A transparent ink-receiving sheet having anti-blocking properties, comprising:

(a) a polymer substrate;

(b) an ink-receptive coating disposed on at least one side of said substrate, comprising at least one layer which comprises a water-soluble component; and (c) polymeric particulates dispersed in said ink-receptive coating, having an average particle size of from about 15 um to about 50 um, a particle size span equal to or smaller than 1.0 and a refractive index of from about 1.2 to about 2.4;

provided that the ink receptive coating is present in an amount of from about 2 $g/m^2$ to about 30 $g/m^2$.

17. A transparent ink-receiving sheet having anti-blocking properties, comprising:

(a) a polymer substrate;

(b) an ink-receptive coating disposed on at least one side of said substrate, comprising at least one layer which comprises a water-soluble component; and (c) organic particulates dispersed in said ink-receptive coating, having an average particle size of from about 15 um to about 50 um, a particle size span equal to or smaller than 1.0 and a refractive index of from about 1.2 to about 2.4;

provided that the ink receptive coating is present in an amount of from about 2 $g/m^2$ to about 30 $g/m^2$.

* * * * *